US006837279B2

(12) United States Patent
Moerman et al.

(10) Patent No.: US 6,837,279 B2
(45) Date of Patent: Jan. 4, 2005

(54) SELVAGE FORMER FOR A WEAVING MACHINE

(75) Inventors: Arnold Moerman, Bikschote (BE); Eddy Verclyte, Ieper (BE)

(73) Assignee: Picanol N.V., Ipeper (BE)

( * ) Notice: Subject to any disclaimer, the term of this patent is extended or adjusted under 35 U.S.C. 154(b) by 254 days.

(21) Appl. No.: 10/258,619

(22) PCT Filed: May 5, 2001

(86) PCT No.: PCT/EP01/05112

§ 371 (c)(1),
(2), (4) Date: Nov. 7, 2002

(87) PCT Pub. No.: WO01/86047

PCT Pub. Date: Nov. 15, 2001

(65) Prior Publication Data

US 2003/0178088 A1 Sep. 25, 2003

(30) Foreign Application Priority Data

May 8, 2000 (BE) ..... 2000/0311

(51) Int. Cl.[7] ..... D03D 47/48
(52) U.S. Cl. ..... 139/434

(58) Field of Search ..... 139/434, 435.4, 139/194

(56) References Cited

U.S. PATENT DOCUMENTS

| | | | | | |
|---|---|---|---|---|---|
| 1,426,351 | A | * | 8/1922 | Brooks | 139/434 |
| 2,267,287 | A | * | 12/1941 | Moessinger | 139/434 |
| 4,957,144 | A | * | 9/1990 | Watanabe et al. | 139/434 |
| 6,240,976 | B1 | * | 6/2001 | Satoh et al. | 139/434 |
| 6,321,796 | B1 | * | 11/2001 | Sawada | 139/434 |
| 6,422,270 | B2 | * | 7/2002 | Nakada et al. | 139/434 |

FOREIGN PATENT DOCUMENTS

| | | | | | |
|---|---|---|---|---|---|
| EP | 0291744 | A | * | 11/1988 | 139/434 |
| EP | 1046736 | A | * | 10/2000 | 139/434 |

* cited by examiner

*Primary Examiner*—Danny Worrell
(74) *Attorney, Agent, or Firm*—Bacon & Thomas, PLLC

(57) ABSTRACT

A selvage bracket (15) including a rotatable insert (33) is used in a weaving machine selvage insertion device (1), the insert is connected to at least one source of compressed air and includes at least one blowing aperture (37). The direction of blowing of the aperture is adjustable by changing the position of the insert relative to the holder.

11 Claims, 7 Drawing Sheets

FIG. 3
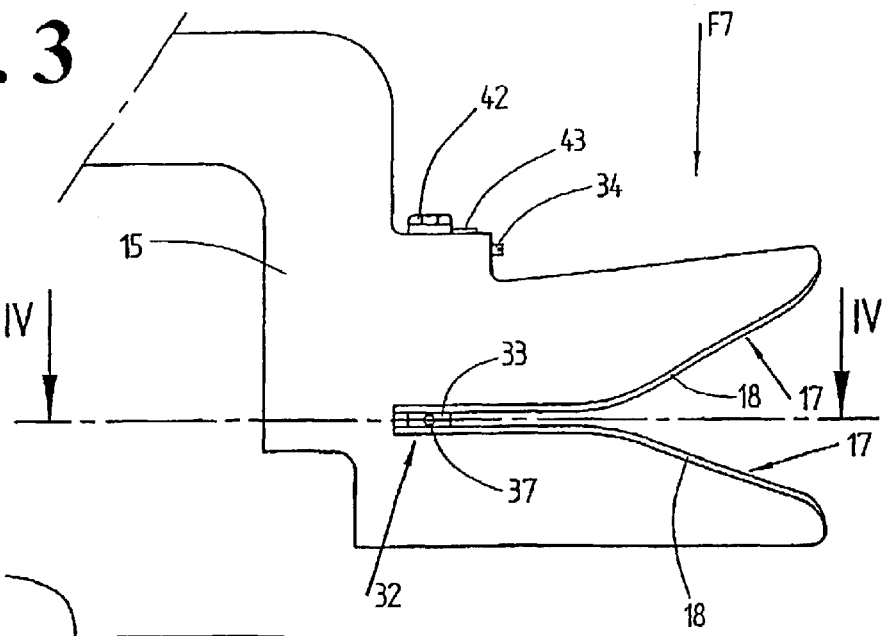
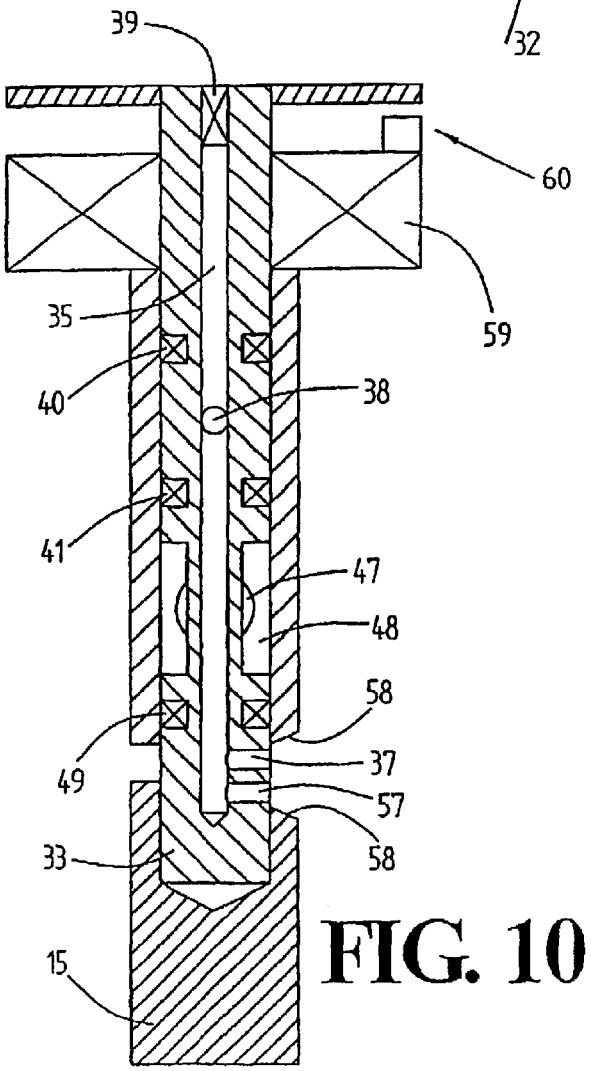
FIG. 10
FIG. 13
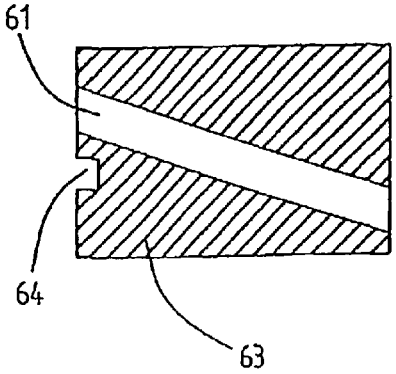

SELVAGE FORMER FOR A WEAVING MACHINE

BACKGROUND OF THE INVENTION

1. Field of the Invention

The present invention relates to a selvage former for tucking an end of a filling into a shed of a weaving machine, comprising a bracket carrying a means for receiving the end of a filling inserted into a shed, and a means for blowing the end into a subsequently formed shed, the means for blowing being connectable by a valve actuated by a control unit to a source of compressed air.

2. Related Art

Such a selvage former is known from U.S. Pat. No. 4,957,144. The end of an inserted filling is initially retained pneumatically and then is blown by blowing orifices into a shed. The blowing orifices are provided in a tuck-in device located adjacent the side of the shed. A selvage former also is known from U.S. Pat. No. 1,426,351 wherein a filling end is received within a guide element and then is blown by a blowing means into the subsequently formed shed. The blowing means includes a nozzle disposed at an angle relative to the fabric's beatup filling to blow the filling end held in the guide element in the direction of the beatup filling. Another device is known from U.S. Pat. No. 2,267,287 wherein several nozzles each operating in a different blowing direction are used in order to deflect the end of a filling and to blow it in the direction of the beatup filling.

3. Brief Summary of the Invention

The objective of the present invention is to so design a selvage former of the described type that it may be used for any fabric.

This objective is realized in that said bracket is fitted with a minimum of one rotatable insert which may be connected to a source of compressed air and which comprises at least one blowing aperture having an adjustable position.

The selvage former may be easily matched to the fabric and/or to the filling to be woven by changing the position of the blowing aperture. The position of the blowing aperture may be changed by exchanging said insert with another one having a different blowing aperture or by locating the blowing aperture at a different location and/or in that the insert is rotatable and in particular is rotatable with respect to its angular position. This feature is advantageous when there is a change in the fabric to be woven. Also said insert may be exchanged when worn without the complete bracket or the complete selvage former being exchanged and/or disassembled.

In a preferred embodiment, the insert is fitted both with an axial duct which may be connected to a source of compressed air and with at least one substantially radially pointing blowing aperture. Such a design proves advantageous in blowing a filling end into a shed.

In a preferred embodiment of the present invention, the bracket is fitted with a guide slot for the fillings and the insert(s) is (are) mounted in front of an end of the guide slot. Advantageously at least some of the elements making contact with the fillings are fitted with wear-resistant covers. As a result, such covers may be replaced in a problem-free manner without having to replace the entire holder or the entire device of the invention. The insert may be a part that is subject to wear and may be replaced as needed.

In accordance with a further embodiment of the present invention, the bracket is fitted with a pneumatic retaining element for retaining the end of a filling. As a result, the filling may be held in a specific location from which it may be blown by the blowing aperture into the shed. This pneumatic retaining element furthermore is appropriate to hold a filling end following severance of the filling.

In a preferred embodiment of the present invention, a filling cutting system is mounted on the side of the bracket which faces away from the fabric. As a result, the length of the filling to be blown by the selvage former into the shed may be determined precisely. Advantageously, the cutting system is located at an adjustable distance from the bracket so that the length of the filling to be blown into the shed is adjustable.

In a further embodiment of the present invention, the bracket is fitted with a minimum of one blowing aperture located in the region of a side wall of the bracket facing the fabric. Such a blowing aperture makes it possible, besides blowing onto the filling end, to point one or more air jets onto the warps in order to prepare the edge of the shed, which is formed of warps, for the purpose of blowing a filling end into said shed. Advantageously a minimum of one blowing aperture located in the region of the side wall of the bracket is located in an insert that may be rotated to adjust the direction of the blowing aperture.

In a further embodiment of the invention, a drive preferably actuated by the weaving machine control is associated with at least one insert which is fitted with at least one blowing aperture which is used to insert the filling end into a shed. The insert may be adjusted by an operator via an input to the control unit after the operator has checked the selvage formed by inserting the filling into a shed. The insert adjustment also may be carried out using data generated by a pickup and transmitted to the control unit, for instance as a function of camera-recorded imaging of the inserted end of the filling.

DESCRIPTION OF THE DRAWINGS

Further advantages and features of the present invention will become evident in the following description and the illustrative embodiments shown in the attached drawings.

FIG. 3 is a partial sideview taken, in the direction of the arrow F3 of FIG. 1 of the selvage former, FIG. 10 is a cross-sectional view similar to that of FIG. 6 of another embodiment, FIG. 13 is a cross-sectional view taken along line XIII—XIII of FIG. 11.

DETAILED DESCRIPTIONS OF THE PREFERRED EMBODIMENTS OF THE INVENTION

Figure 1:
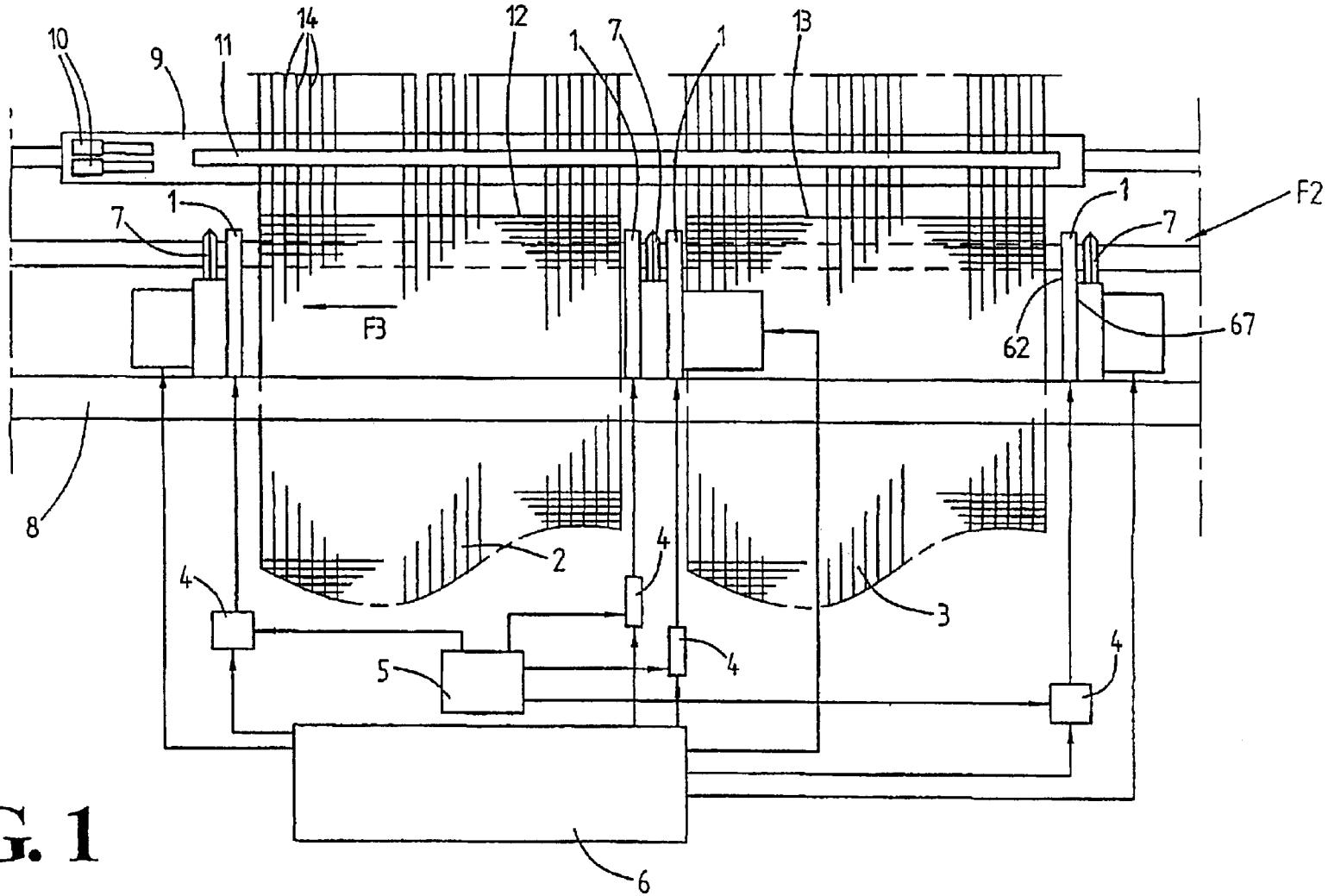
FIG. 1 is a diagrammatic top view of an airjet weaving machine fitted with several former made according to this invention.

Two fabrics 2, 3 are woven next to each other on the airjet weaving machine shown in FIG. 1 and are associated with a total of four selvage formers 1. Each selvage former 1 is fitted with one controlled cutting system 7 driven by a control unit 6. A common cutting system 7 is used for the two central selvage formers 1. The selvage formers 1 and the cutting systems 7 are displaceably affixed on one cross-beam 8 running transversely to the direction of weaving. The airjet weaving machine furthermore contains a batten 9 fitted with several main nozzles 10 and one reed 11. The inserted fillings are beaten by the reed 11 against a beat-up line 12, 13 of the respective fabrics 2, 3. A shed is formed from warps 14 by shed-forming means (not shown) to enable insertion of fillings. Each selvage insertion device 1 is connected by a valve driven by a control unit 6 to a source of compressed air.

Figure 2:
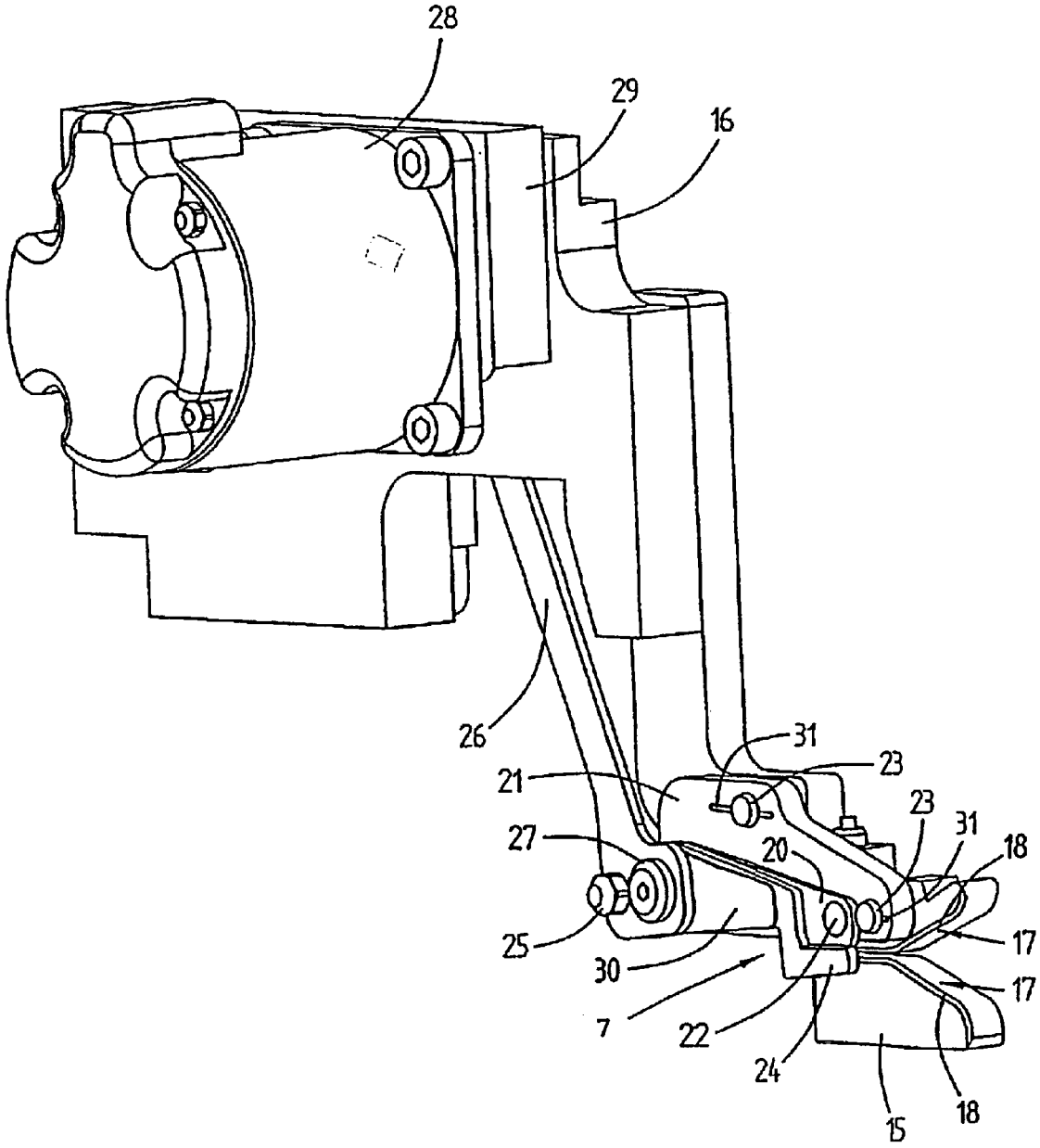
FIG. 2 is a perspective elevated view taken in the direction of arrow F2 of FIG. 1 of the selvage former fitted with a cutting system.

The selvage former 1 shown in FIG. 2 comprises a bracket 15 affixed by a brace 16 in manner not further described to the cross-beam 8. The bracket 15 is fitted with a guide slot which is subtended by guide elements 17 and which widens in a V-manner opposite the direction of beatup and merges into a narrow close-ended slit running substantially parallel to the plane of the fabric. The guide elements 17 guide the filling inside the bracket 15. The guide elements 17 are fitted with wear-resistant covers 18, for example, made of ceramic or steel.

A cutting system 7 is affixed to the bracket 15. This cutting system 7 includes a stationary scissors blade 20 affixed by screws 22 to an intermediate element 21 which in turn is affixed by screws 23 to the bracket 15. A movable scissors blade 24 is linked by a bolt 25 to a lever 26. This lever 26 in turn is affixed by a ball-and-socket joint 27 to the intermediate element 21. The lever 26 is linked to a controlled drive motor 28 which in turn is affixed by an intermediate element 29 to the brace 16. A leaf spring 30 is configured between the lever 26 and the movable scissors blade 24 and presses the blade 24 against a stationary blade 20. The distance between the cutting system 7 and the bracket 15 may be varied in the direction of the pick by means of spacer disks, (not shown) between the bracket 15 and the intermediate element 21. This process can be carried out on account of the ball-and-socket joint 27 without having to shift the drive motor 28. Adjustment may also be attained by using an intermediate element 21 of different thickness. In the embodiment shown, the intermediate element 21 is fitted with elongated slots 31 for the screws 23 so that the position of the cutting system 7 also may be adjusted transversely to the pick direction.

As shown in FIGS. 3 through 7, the bracket 15 is fitted with filling end blower means 32 to blow a filling end into a shed. These means 32 include a cylindrical insert 33 which is rotatably disposed within the bracket 15 for rotation relative to the bracket and which may be secured in place by a clamping screw 34 at a predetermined angular position in the bracket 15. The insert 33 comprises an axial duct 35 communicating through radial boreholes 38 with a compressed-air feed duct 36 of the bracket 15. The axial duct 35 terminates at blowing apertures 37 of the insert 33 that are situated in the region of the guidance slot (FIG. 6) of the bracket. The blowing apertures extend substantially radially and direct compressed air supplied through duct 36 in a blowing direction generally aligned with the aperture.

Figure 5:
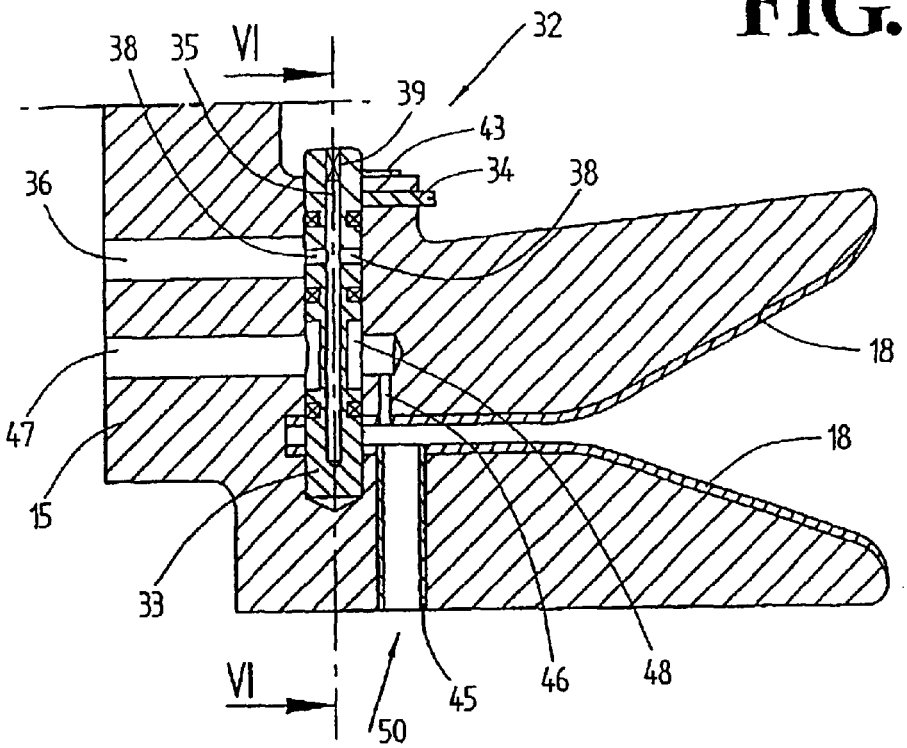
FIG. 5 is a cross-sectional view taken along line V—V of FIG. 4.

As shown in FIG. 5, the insert 33 comprises at least two mutually opposite radial boreholes 38 as a result of which the same insert 33 may be used for a selvage insertion device 1 at the left or right of a fabric. Sealing rings 40, 41 are located in the zone above and below the radial boreholes 38. The end of the axial duct 35 located away from the blowing aperture 37 is sealed by a sealing element 39. The upper end of the insert 33 projecting from the bracket 15 is fitted with a tool engaging surface—in this embodiment a hexagon 42—whereby the insert may be gripped and rotated. The insert 33 is fitted with a pointer 43 which is associated with a scale 44. The pointer 43 is located 90° away from the direction of the blowing aperture 37.

The bracket 15 also is fitted with a pneumatic retaining element 50 for retaining the filling end. This retaining element 50 comprises a duct running transversely to the pick direction in the bracket 15 and is clad by a tube 45 preferably made of a wear-resistant material. A blowing aperture 46 points at said tube 45. In this particular embodiment, the insert 33 and the tube 45 are located in a common plane 51 which runs perpendicularly to the pick direction. Using a valve system 4 (FIG. 1), compressed air is fed through a compressed-air feed duct 47 of the bracket to the blowing aperture 46. The duct 47 runs through the receiving borehole of the insert 33, with the insert in this region being fitted with a cross-sectional constriction 48. The region of this cross-sectional constriction is sealed relative to the outside by the sealing ring 41 and by a further sealing ring 49.

Figure 4:
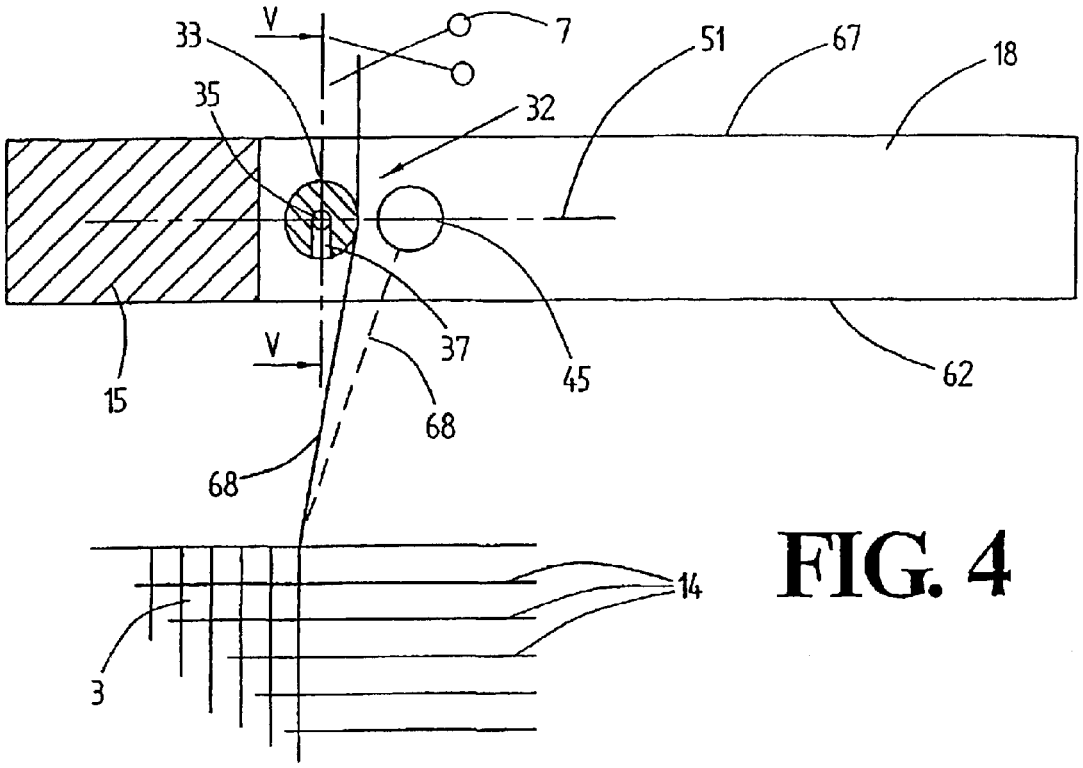
FIG. 4 is a cross-sectional view taken along line IV—IV of FIG. 3.

The selvage former 1 of the present invention operates in the following manner as described in relation to FIG. 4. A filling 68 inserted into a shed is moved by the reed 11 between the guide faces 17 of the bracket 15, and as a result the filling 68 is received in the bracket 15. The filling is guided by the motion of the reed 11 as far as the insert 33. Thereupon the filling is cut off by the cutting system 7 at the sidewall 67 of the bracket 15 located away from the fabric 2 or 3. The blowing aperture 46 blows compressed air into the tube 45 and the end of the filling 68 is blown into the tube 45 as indicated by the dashed lines in FIG. 4. Thereupon the compressed air is fed to the blowing aperture 37 and blows the end of the filling 68 into the subsequently formed shed. This blown-in end then is beaten by the reed 11 jointly with the next filling against the beatup lines 12, 13 of the fabrics 2, 3.

Figure 8:
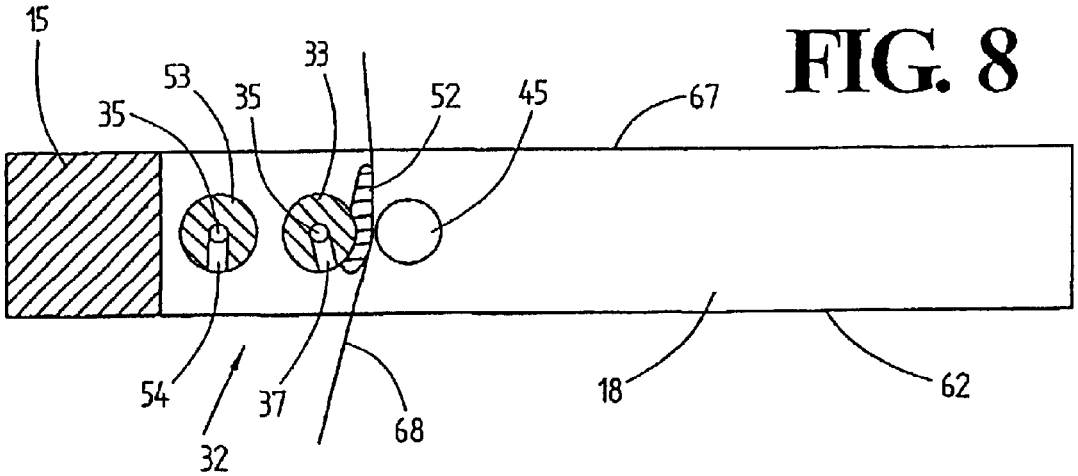
FIG. 8 is a cross-sectional view similar to that of FIG. 4 of a different embodiment.

As regards the illustrative embodiment of FIG. 8, the insert 33 is fitted with a wear-resistant cover 52 that prevents a filling from affecting the insert 33. In addition, in this embodiment use is made of a second insert 53 of the geometry of which corresponds to that of the insert 33 and which is fitted with a further blowing aperture 54 for the purpose of blowing a filling end into a shed. Using appropriate switching means, the air flow from the blowing aperture 37 of the insert 33 may be used with respect to a particular filling to blow a filling end into the shed. However as regards another filling, air flow expelled from the blowing aperture 54 of the insert 33 may be used. Again the airflows expelled from both inserts 33, 53 may be used to insert the filling end by compressed air being applied to both inserts 33, 53 at the same time or in a mutually offset manner.

Figure 9:
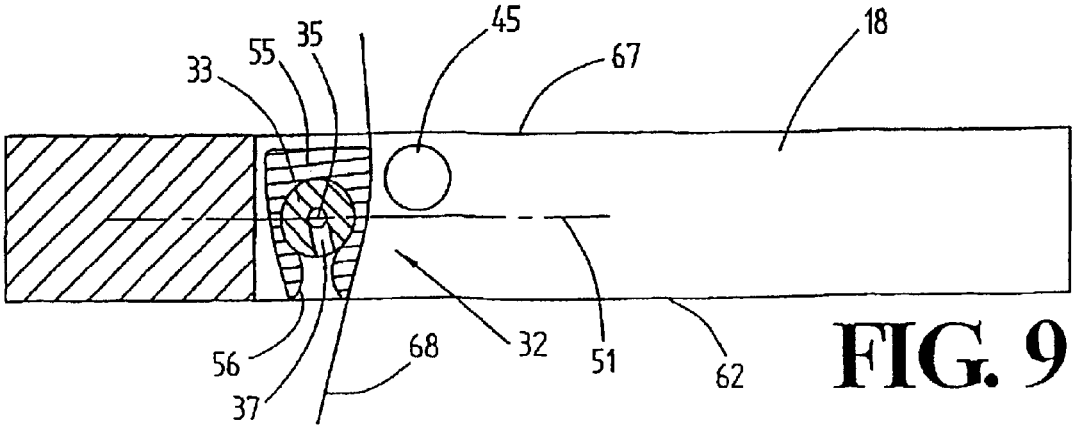
FIG. 9 is a cross-sectional view similar to that of FIG. 4 of a different embodiment.

As regards the illustrative embodiment of FIG. 9, the insert 33 is enclosed by a wear-resistant cover 55 wrapped about a nozzle-shaped flow duct 56 for the purpose of guiding the airflow expelled from the blowing aperture 37 of the insert 33. The angular position of said cover 55 may be adjusted in relation to the angular position of the insert 33. In the embodiment of FIG. 9, the pneumatic retention element is configured at an offset to the center plane 51 of the bracket 15, that is, the duct 45 is offset relative to said center plane in the direction of that side wall 67 of the bracket 15 which is located away from the fabric. In this design the bracket 15 is not fitted with a tube acting as an insert. The borehole in the bracket 15 is surface-treated to increase wear resistance.

With respect to the embodiment of FIG. 10, the insert 33 is fitted with two blowing apertures 37, 57 one above the other which are aimed towards the shed in the region of the guide slot. In this embodiment, as shown, the blowing apertures 37, 57 point in the same direction. However, in another embodiment, the blowing apertures 37, 57 are mutually circumferentially offset and blow in different directions. In a further embodiment of the invention, more than two blowing apertures 37, 57 are provided, and which are configured in juxtaposed or superposed manner and which may blow in the same and/or in different directions. As FIG. 10 also shows, the bounding walls 58 of the guide slot in the region of the blowing apertures 37, 57 flare outward in the form of bevels to prevent such boundaries from interfering with the airflows.

FIG. 10 also shows that the insert 33 as constituting the rotor of a controlled drive motor 59. The angular position of the insert 33 and hence that of the drive motor 59 is determined by the control unit 6 (FIG. 1) of the airjet weaving machine. Illustratively, the drive motor 59 may be a stepping motor. This embodiment also includes an encoder 60 connected to the control unit 6 which is used to specify the angular position of the insert 33.

Figure 12:
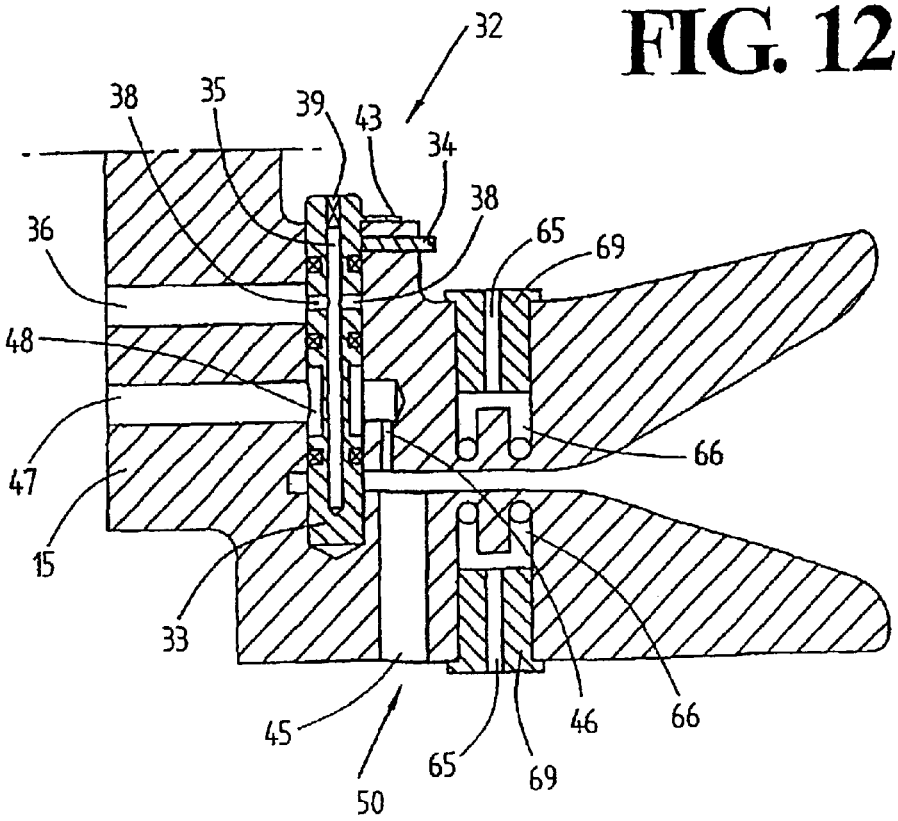
FIG. 12 is a cross-sectional view corresponding to that of FIG. 5 of the embodiment of FIG. 11.
Figure 6:
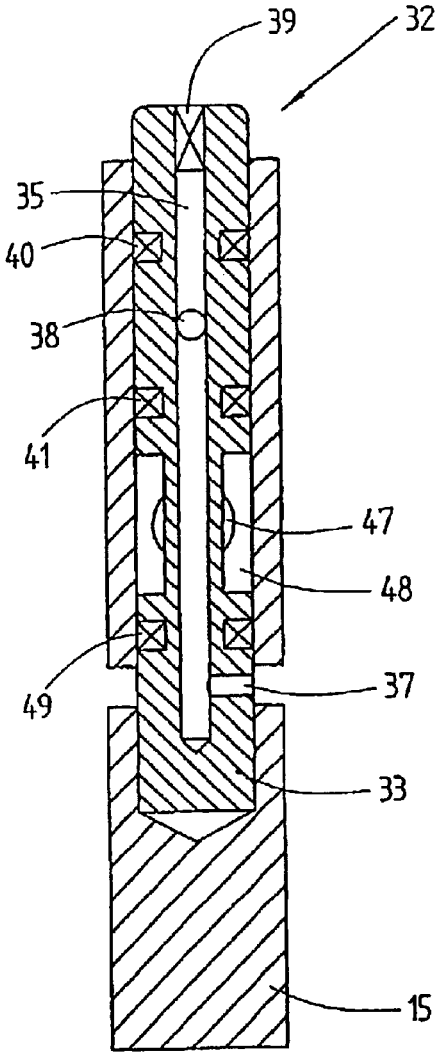
FIG. 6 is a cross-sectional view taken along line VI—VI of FIG. 5.
Figure 7:
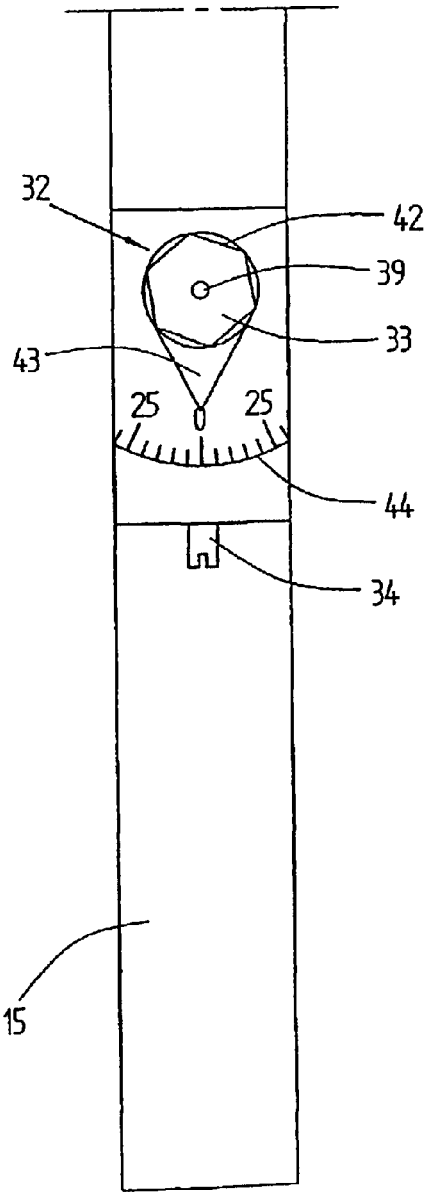
FIG. 7 is an elevational view taken in the direction of arrow F7 of FIG. 3.
Figure 11:
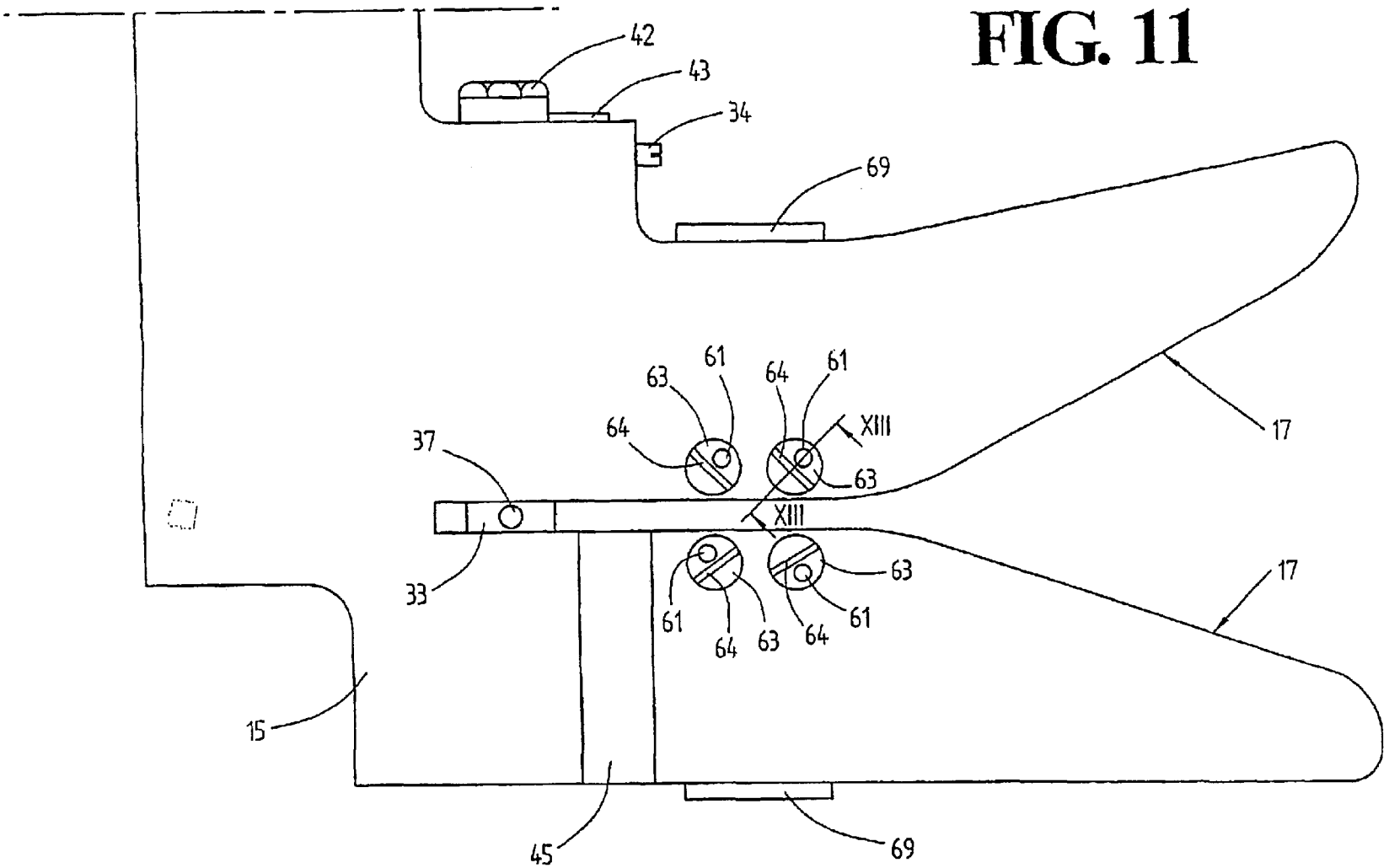
FIG. 11 is an elevational view similar to that of FIG. 3 of another embodiment.

As regards the embodiment of FIGS. 11 through 13, the selvage former 1 is fitted with further secondary blowing apertures 61 which terminate at the fabric-facing sidewall 62 of the bracket 15. These secondary blowing apertures 61 blow air streams toward the warps in order that the shed is ready for blowing filling ends into it. These secondary blowing apertures 61 also may contribute to blowing an end of a filling 68 already blown into the shed still deeper into it. Each secondary blowing aperture 61 is fitted in a secondary insert 63 rotatably mounted in the bracket 15. As shown by FIG. 13, the secondary blowing aperture 61 is in the form of an oblique borehole in the rotatable secondary insert 63, as a result of which, when this insert 63 is being rotated, not only the position of the secondary blowing aperture, but also the direction of the expelled airflow may be changed. This adjustment may be implemented as a function of the fabric to be woven, and in particular as a function of the kind of filling and/or the kind of warps used. To allow adjustment of the angular position of the secondary insert 63, it is screwed by means of an outside thread of small lead into a matching inside thread of the bracket 15. The end face of the insert 63 is fitted with a slit 64 to allow its rotation using a tool. A securing element may be provided between the outside thread of the insert 63 and the inside thread of the bracket 15 to secure the insert 63 in the adjusted angular position. As shown by FIG. 12, the bracket 15 is fitted with elements 69 which comprise compressed-air intakes 65 and which are connected with the valve 4 (FIG. 1) by means of feed lines 66, and with a source of compressed air applying compressed air to the secondary blowing apertures 61. In an embodiment variant, the secondary blowing apertures 61 communicate with the compressed-air feed duct 47, that is, with the compressed-air feed to the pneumatic retaining element. As a result compressed air already may be expelled from the secondary blowing apertures 61 before compressed air is applied to the blowing apertures 37 of the insert 33 and the filling end is blown into the shed. Although in the shown embodiment several secondary inserts 63 with secondary blowing apertures 61 are used, only one of such secondary inserts 63 may suffice in a variation of this embodiment.

As shown in particular in FIG. 11, the guide faces 17 of the bracket 15 are not fitted with a wear-resistant cover 18. To attain adequate wear resistance, a surface treatment preferably is used.

The invention is applicable to weaving with abrasive fillings. By adjusting the inserts 33, 53 or 63, the direction of the air flow(s) may be adjusted in such a manner that the filling end runs parallel with the beatup line 12 or 13 and in this form is beaten up with the next filling.

The invention is not restricted to airjet weaving machine applications. Such selvage insertion devices also are appropriate for other weaving machines such as gripper weaving machines, multiphase weaving machines such as weaving rotors, gripper shuttle weaving machines, waterjet weaving machines, projectile weaving machines and other weaving machines.

The bracket 15 of the selvage insertion device 1 of the invention may comprise further blowing apertures besides the blowing apertures 37, 57 in an insert 33 or the secondary blowing apertures 61 in a secondary insert 63, and said further blowing apertures may be designed as boreholes in said bracket 15.

Instead of the pneumatic retaining elements 50, the bracket 15 also may comprise other retaining elements. Illustratively the fillings may be kept in place by so-called selvage threads or by a mechanical filling clamp between the insert 33 and the cutting system 7.

Furthermore other designs may be provided instead of a blowing aperture 46 blowing the filling 68 into the tube 45, for example by connecting a vacuum line to the tube 45.

The selvage insertion device 1 of the invention offers the advantage that, by means of a few modifications, in particular adding one or several valves 4 and a control unit 6, it may be retrofitted into extant weaving machines in a problem-free manner.

The invention is not restricted to the above shown and discussed illustrated embodiments. These embodiments may be readily modified without departing from the scope of the invention.

What is claimed is:

1. Selvage former for a weaving machine comprising:

a holder carrying a means for taking up an end of a filling after its insertion into a first shed and a means for blowing the end of said filling into a subsequently formed shed, said means for blowing being connectable to a source of compressed air by valves which valves are controlled by a control unit, and wherein the means for blowing is equipped with at least one insert being connectable to the source of compressed air and having at least one blowing aperture defining a blowing direction, which insert is rotatable for adjusting the blowing direction of the blowing aperture.

2. Selvage former as claimed in claim 1, wherein said air supply insert comprises an axial duct connectable to said source of compressed air and said at least one blowing aperture points in a radial direction.

3. Selvage former as claimed in claim 1, said means for taking up an end of a filling including a filling guide slot having an open end and a closed end and wherein said insert is mounted in front of and adjacent said closed end.

4. Selvage former as claimed in claim 1, said bracket including at least one surface exposed to contact with filling ends, said at least one surface including a wear resistant cover.

5. Selvage former according to claim 1, said means for taking up an end of a filling including a pneumatic retention arrangement located so as to receive and hold a filling end by means of compressed air and a compressed air supply arrangement configured so that compressed air supply supplied to the bracket is directed to the pneumatic retention arrangement whereby a filling end may be pneumatically retained in the means for taking up an end of a filling between insertions.

6. Selvage former according to claim 1, including a filling cutting system located towards a side of the bracket opposite a side of the bracket towards which the insert aperture faces.

7. Selvage former according to claim 6, wherein the cutting system is movable relative to the bracket for adjusting the distance between the bracket and a filling cutter associated with the cutting system.

8. Selvage former according to claim 1, said bracket including secondary blowing apertures the blowing directions of which face towards the same side of the bracket as the direction of blowing of the insert aperture.

9. Selvage former according to claim 8, wherein at least one of said secondary apertures is disposed in a secondary insert that is movably mounted relative to the bracket, said secondary insert and secondary aperture disposed such that motion of the secondary insert relative to the bracket enables changing the blowing direction of the secondary aperture relative to the bracket.

10. The selvage former according to claim 1, including a drive motor carried by said bracket and connected to said at least one insert, the connection of said drive motor to said insert enabling rotation of said insert upon controlled actuation of said motor to vary the blowing direction of the insert relative to the bracket.

11. Selvage former as claimed in claim 1, said insert including at least one surface facing towards filling ends during sequential filling insertions, and including a wear resistant cover over said at least one surface.

* * * * *